United States Patent [19]

Inamori

[11] 3,975,023

[45] Aug. 17, 1976

[54] GOLF CLUB HEAD WITH CERAMIC FACE PLATE

[75] Inventor: Kazuo Inamori, Kyoto, Japan

[73] Assignee: Kyoto Ceramic Co., Ltd., Kyoto, Japan

[22] Filed: Feb. 26, 1974

[21] Appl. No.: 445,984

Related U.S. Application Data

[63] Continuation of Ser. No. 314,678, Dec. 13, 1972, abandoned.

[30] Foreign Application Priority Data

Dec. 13, 1971 Japan ..... 46-117327[U]

[52] U.S. Cl. ..... 273/173

[51] Int. Cl.[2] ..... A63B 53/04

[58] Field of Search ..... 273/77 R, 78, 167 R, 273/167 D, 167 J, 173, 175

[56] References Cited

UNITED STATES PATENTS

| | | | |
|---|---|---|---|
| 727,819 | 5/1903 | Mattern | 273/78 |
| 1,088,571 | 2/1914 | Heffernan | 273/78 |
| 1,562,956 | 11/1925 | Guerne | 273/173 X |
| 1,595,589 | 8/1926 | Tyler | 273/173 X |
| 2,034,936 | 3/1936 | Barnhart | 273/78 |
| 2,201,638 | 5/1940 | Theibault | 273/173 X |
| 2,908,502 | 10/1959 | Bradstreet et al. | 273/173 X |
| 3,172,667 | 3/1965 | Baker et al. | 273/173 |
| 3,218,072 | 11/1965 | Burr | 273/167 J X |
| 3,390,881 | 7/1968 | Senne | 273/167 R X |
| 3,695,618 | 10/1972 | Woolley et al. | 273/78 X |

FOREIGN PATENTS OR APPLICATIONS

| | | | |
|---|---|---|---|
| 827,567 | 1/1938 | France | 273/167 J |
| 692,134 | 6/1940 | Germany | 273/173 |
| 4,301 | 2/1912 | United Kingdom | 273/167 J |
| 1,062,796 | 3/1967 | United Kingdom | 273/167 J |
| 1,227,948 | 4/1971 | United Kingdom | 273/173 |
| 9,742 | 6/1895 | United Kingdom | 273/167 R |
| 14,736 | 6/1909 | United Kingdom | 273/173 |

OTHER PUBLICATIONS

"Van Nostrand's Scientific Encyclopedia," 1968, pp. 313, 314, 776 and 777.

*Primary Examiner*—Richard J. Apley
*Attorney, Agent, or Firm*—Spensley, Horn & Lubitz

[57] ABSTRACT

This invention relates to a golf club head capable of increasing the flying distance of the ball hit in a substantial degree, imparting a refreshing feeling of ball hitting to the player and being manufactured at low cost and durable for long time use by fixing the striking face of the club head with a ceramic face plate made of a sintered body of metallic oxides such as alumina ceramics, mullite ceramics, etc.

10 Claims, 7 Drawing Figures

GOLF CLUB HEAD WITH CERAMIC FACE PLATE

This application is a continuation of the parent application Ser. No. 314,678 which was filed on Dec. 13, 1972, and is now abandoned. The priority papers pertaining to Japanese application, Ser. No. 117,327 filed on Dec. 13, 1971 have been filed in connection with the above denoted parent application and the priority date of the Japanese filing is hereby claimed pursuant to 35 U.S.C. 119.

BACKGROUND OF THE INVENTION

1. Field of the Invention

This invention relates generally to improvements in a golf club head and more particularly to a golf club head equipped on its striking face with a ceramic face plate in order to increase the flying distance of a golf ball.

2. Description of the Prior Art

Conventionally, wood clubs and plastic clubs are fitted on their respective striking faces with face plates to thereby protect the faces and increase the flying distance of the ball struck. The essential property for the face plate is that the plate should be harder than the club head and can impart strong elastic resilience to the ball and that, when it is fixed to the head, it should have good affinity to the head. Materials which have been employed as a face plate include such materials as glass fiber reinforced polyester resin (FRP), polyamide resin (nylon), acrylbutadiene styrol copolymerized resin (ABC resin), ivory, etc., singly or in combination, but they have various advantages and disadvantages. For example, in the case of the above plastics, they have the advantage of being light in weight, low in cost and excellent in affinity to a club head, but have the disadvantage of stress deformation resulting in the face part between the face plate and the ball gradually becoming deformed. This is particularly increased by mud and small stones coming between the face part and the ball during play. The deformation eventually causes the club to be unfit for long use. With regards to ivory, it is great in resilience and energy transfer to a ball, but has the disadvantage of being heavy and expensive and, in addition, lacking affinity to a club head.

SUMMARY OF THE INVENTION

The present invention employs a face plate made of a particular ceramics. Because the ceramics has a rough surface of fine irregularities resulting from its being an aggregate of a fine crystal grain and is therefore free from stress deformation even if subjected to external force below destruction point and because it is light in weight, the face plate and golf head are particularly effective in solving the problems of the prior art. It has been found that the use of alumina ceramics as the face plate can increase the flying distance of a ball by about 30% and enables a shot that is pleasing and refreshing to a player with a clean striking sound and, in addition, the use of ceramics enables a light and inexpensive club.

Accordingly, a primary object of this invention is to provide a golf club head great in elastic resilience (and energy transfer) to a ball and capable of markedly increasing the flying distance of the ball.

Another object of this invention is to provide a strong, durable and inexpensive golf club of the character described in connection with the primary object.

Still another object of the invention is to provide a golf club capable of giving a refreshing feeling and sound of the shot without involving obstruction to the swing of a club.

These and other objects and advantages of this invention will become apparent from the following description, taken in conjunction with the accompanying drawings, of preferred embodiments of the invention shown by way of example.

DESCRIPTION OF THE PREFERRED EMBODIMENTS

Figure 1:
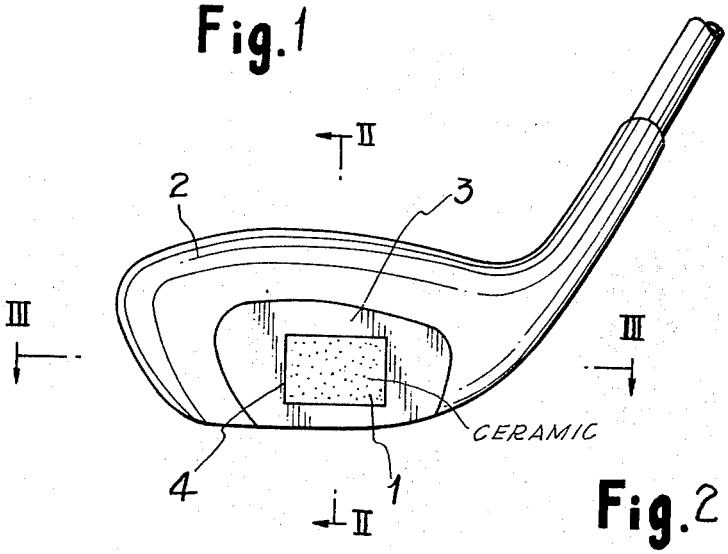
FIG. 1 is a front view of a golf club head according to one embodiment of this invention.
Figure 2:
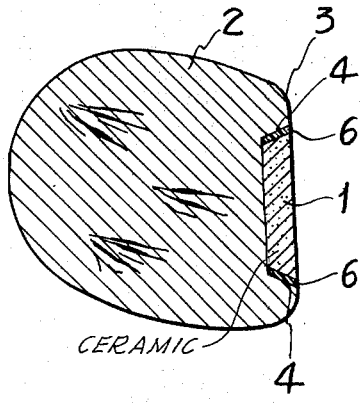
FIG. 2 is a sectional view taken along the line II—II of FIG. 1.
Figure 3:
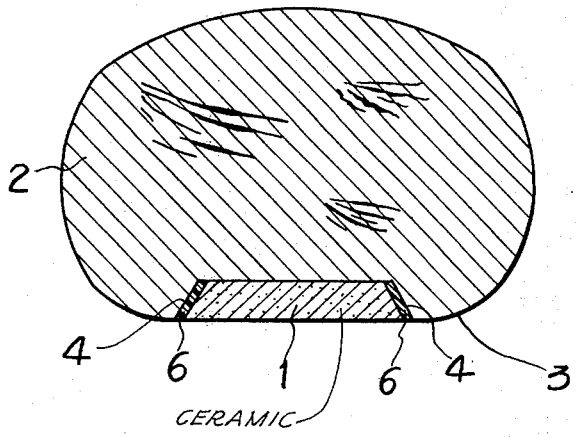
FIG. 3 is a section view taken along the line III—III of FIG. 1.

As apparent from the drawings, this invention relates to a golf club head fitted on the striking face of the head with a ceramic face plate. A description will be made of the invention with reference to a wood club head shown by way of example. As a method of fitting the striking face with this face plate are mentioned three embodiments; one embodiment being shown in FIGS. 1 through 3, and another embodiment in FIGS. 4 and 5, and still another in FIG. 6.

Referring now to the first embodiment, the numeral 2 designates a club head; 3 designates a striking face; and 1 designates a ceramic face plate provided on the striking face 3. The ceramic face plate 1 is made of ceramics of metallic oxides such as alumina ($Al_2O_3$), mullite ($3Al_2O_3.2SiO_2$), zirconium ($ZrO_2.SiO_2$), beryllium oxide (BeO), etc., sintered into one body at high temperatures ranging from 1200° to 1700°C. During this processing step the metallic oxides have their crystal water expelled successively by heating and are melted, and this eutectoid is crystallized at the temperatures described above to thereby form an aggregate of fine crystals of high melting-point. The aggregate of the kind described contains but a very small spaces and is water-nonabsorbable and dense, has a rough surface of very fine irregularities ranging from 5 to 10$\mu$ and has a characteristic of being free from stress deformation due to external force below its destruction point. When economy and mechanical strength are considered, alumina ceramics is the optimum type of the ceramics mentioned above.

Figure 4:
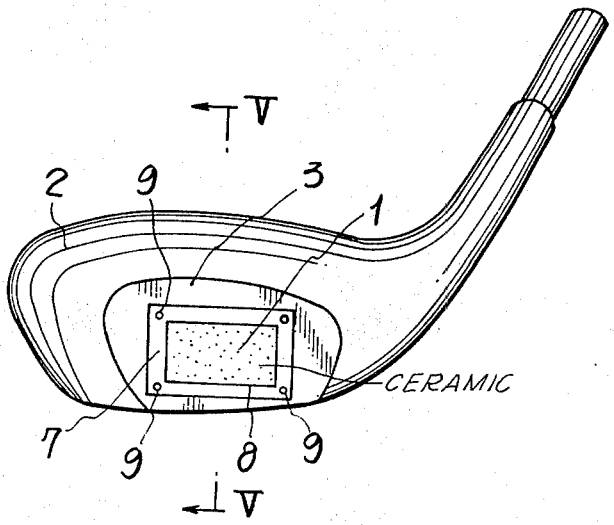
FIG. 4 is a front view of a golf club head according to another embodiment of this invention.
Figure 5:
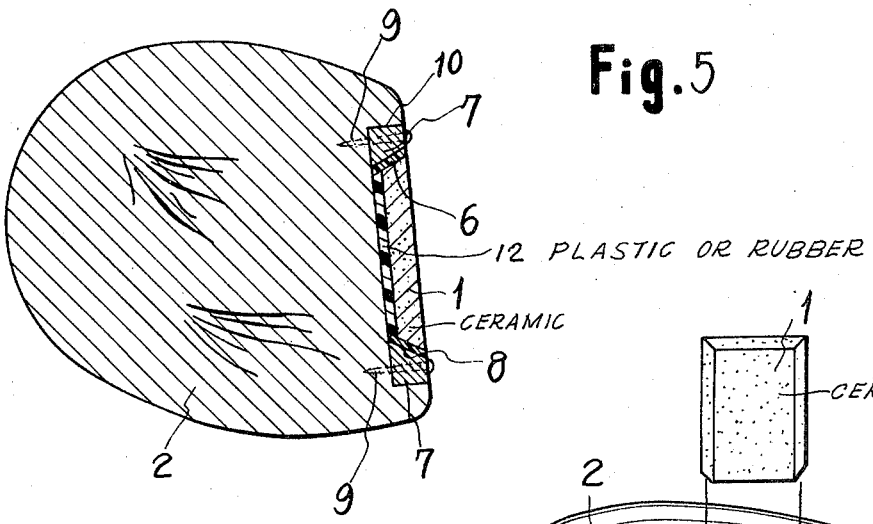
FIG. 5 is a sectional view taken along the line V—V of FIG. 4.

A method of fitting the striking face with the face plate 1 made of this type of ceramics is shown in the first embodiment (FIGS. 1 through 3) square truncated face plate 1 of suitable thickness — say, length $x$ width $x$ thickness $= 20-30$ mm $\times$ $20-30$ mm $\times$ $10-20$ mm — is pushed from the outside through an epoxy resin or other adhesives 6 into a groove 4 and fixed thereto. The groove 4 is formed in the face 2 to conform to the shape of the face plate 1 and is formed slightly tapered or chamfered with the cross-sectional area of the ceramic decreasing from the face side at 3 to the portion of ceramic adjacent the thickened portion of the head. Certain types of club heads are already equipped with face plates made of FRP, ABS resin, polyamide resin, etc., of the type described. Accordingly, the method of applying the face plate of the invention to the club heads already fitted with such face plates is shown in FIGS. 4 and 5. In this case, a groove 8 corresponding to the ceramic face plate is formed in the face plate 7 already fixed to the club head as shown in FIG. 4 and the ceramic face plate 1 is fitted into the groove 8 through an adhesive 6 and held by the face plate 7, and the face plate 7 is fitted into a groove 10 according to the already designed construction and is fixed by wood screws and/or nails 9 . . . to a club head 2. Such use of the already applied face plate 7 as a holder of the ceramic face plate 1 provides the convenience with which to apply the invention to such type of club head without making a substantial modification in the construction of the face plate 7. Furthermore, configurations of the ceramic plate 1 and of the groove 8 corresponding thereto in this embodiment are represented as the same as those shown in the first embodiment.

Figure 6:
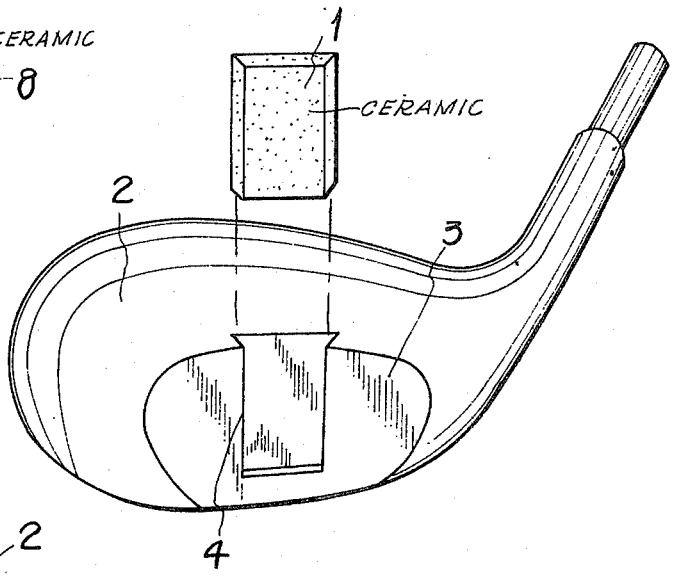
FIG. 6 is an exploded perspective view of a golf club head according to still another embodiment of this invention.

In the third embodiment is shown an example in which, in order to fix the face plate 1 directly to the club head 2, the face plate 1 is fixed to the club head by sliding the plate from either the upper or lower side. Namely, as shown in FIG. 6, the face plate 1 and its mating groove 4 are provided in the club head with the relationship and configuration of a dovetail and a dovetail groove with respect to the upper and lower sides of the head 2. By so doing the face plate 1 is enabled to be slid into the dovetail groove 4 from either the upper or the lower side of the head 2 and is thus fixed to the club head 2. In this case the adhesive 6 is suitably used where necessary.

It is to be understood that the method of fixing the face plate to the club head is not limited to those described with reference to the three embodiments shown.

Figure 7:
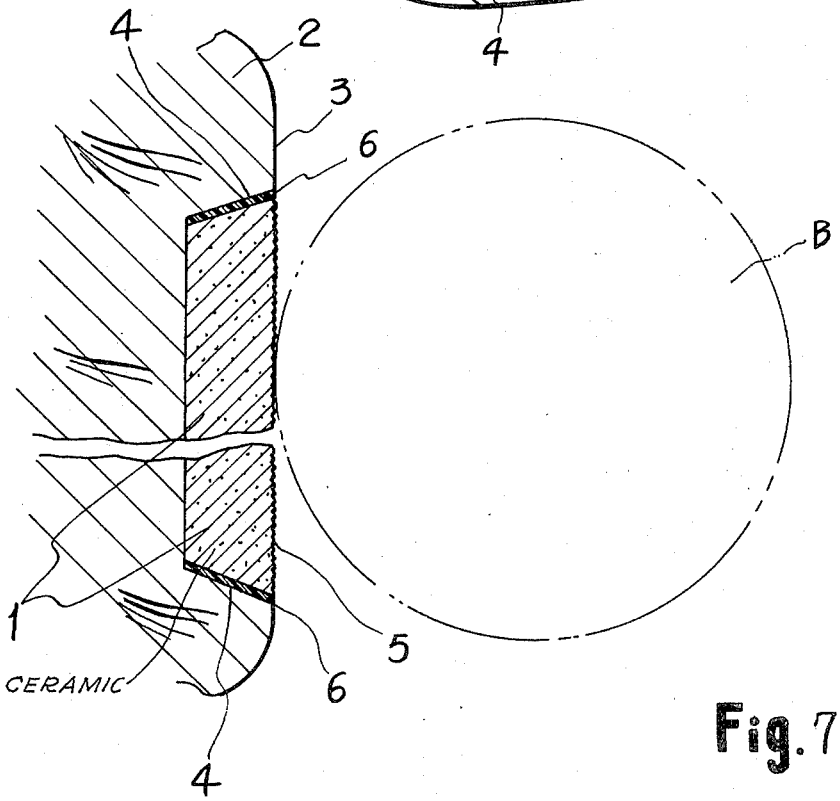
FIG. 7 is a partly enlarged view showing a relation between the ball and the face plate in this invention.

Since the golf club head of the invention, as shown above, is equipped on its striking face 3 with the ceramic plate 1, it can increase the flying distance of a ball in a substantial degree in that it is free from stress deformation even under the effect of impact because it is made of ceramics which is very hard. In addition, when the ball B is hit with the face plate 1, as shown in FIG. 7, the surface of the club head facing the ball B has numerous fine irregularities 5, which provides a large surface of contact between the ball B and the face plate 1 thereby imparting great energy transfer to the ball B.

The surface hardness, wear resistance, elastic resilience to the ball and configuration of surface irregularities depends upon the type of ceramics used. The use of alumina ceramics [compounding ratio of 90% (by weight) of $Al_2O_3$, 5% (by weight) $SiO_2$, 3% (by weight) of CaO, and 2% (by weight) of $K_2O+Na_2O$] makes it possible to obtain a face plate most desirable in point of hardness, wear resistance, resilience, and configuration of rough surface. It is reported that a refreshing feeling and sound of the impact and a 30% increase in the flying distance of the ball struck can be obtained by the use of this alumina ceramic face plate.

According to this invention, the irregular rough surface 5 functions as a means for preventing slip of the ball with respect to the face plate 1. Accordingly, when a player wants to make sure the position in which he can best hit the ball B by bringing the face plate 1 into contact with the ball B, the fine irregularities formed on the surface of the face plate 1 provides frictional force and prevents the ball B from rolling from the position in which the ball is placed. Accordingly, the ball can be correctly set in position, and because this irregular surface 5 also is free from stress deformation, even if the player hits the ball with dust and stones left on the face plate 1, there is no fear of the irregular rough surface being subjected to permanent deformation and the player is assured of long time use of the club. Also, the face plate 1 made of sintered metallic oxides is free from moisture, and accordingly hitting the ball by the head provides a clean refreshing metallic sound to the hitting. The face plate is very light in weight and an increase in the size of the plate does not impart a feeling of increased weight to the club. And, in addition, the plate 1 is very low in cost. The invention thus has a variety of advantages.

Furthermore, ceramics have a large energy transfer coefficient (elastic resilience) with respect to a golf ball and are light in weight, but it has the disadvantage of being relatively fragile to impact force. Accordingly, when the invention is applied to a wood club head, it is desirable to interpose as a shock absorber an elastic sheet such as a plastic film or rubber film between the ceramic face plate and the groove in the wood head. Such a plastic film 12 is clearly shown in FIG. 5 as being disposed in groove 4 so as to be sandwiched between the ceramic face plate 1 and the golf club head 2.

In addition, this invention may be applied to the striking face of an iron club head (including a putter) besides that of the wood club head which has so far been described and illustrated, and in this case not only the advantages of weight saving of the head and the increased resilience of a ball can be obtained, but also the added advantage that the fragility of the ceramic face plate to impact force can be compensated by the toughness of the iron employed.

It should be understood that various changes and modifications may be made in practicing the invention without departing from the scope and spirit thereof, and therefore the invention is not to be limited except as defined in the appended claims.

I claim:

1. A golf club head comprising:

a. a striking face adapted to strike a golf ball, said striking face defining a recessed mating groove;

b. a face plate having a thickness of from about 10 to 20 mm and consisting essentially of a ceramic comprising alumina as the major component, said face plate further characterized as having an irregular exterior surface formed of fine aggregate of said ceramic, said face plate fitted into said mating groove such that said exterior surface of said face plate is flush with said striking face; and c. an elastic sheet member disposed in said mating groove so as to be sandwiched between said face plate and said golf club head.

2. The golf club head in accordance with claim 1 wherein said striking face is formed of material selected from the group consisting of: glass fibers, polyamide resin, acrylbutatiene styrol, ivory, wood, iron, plastic and combinations thereof.

3. The golf club head in accordance with claim 1 wherein said striking face is a separate and discrete element coupled to said golf club head.

4. The golf club head in accordance with claim 3 wherein said striking face is coupled to said golf club head by screw means.

5. The golf club head in accordance with claim 1 wherein said elastic sheet is a rubber film.

6. The golf club head in accordance with claim 1 wherein said face plate is made of a composition comprising about a. 90 wt. percent $Al_2O_3$;
b. 5 wt. percent $SiO_2$;
c. 3 wt. percent CaO; and
d. 2 wt. percent $K_2O + Na_2O$.

7. A golf club head comprising:

a. a striking face disposed on said golf club head adapted to strike a golf ball, said striking face defining a recessed mating groove;
b. a face plate having a thickness of from about 10 to 20mm and having an irregular exterior surface and consisting essentially of a ceramic material comprising alumina as the major component with said irregular surface formed of aggregate of said ceramic material having a particle size in the range of 5 to 10 microns, said face plate fitted into said mating groove such that said exterior surface of said face plate is flush with said striking face; and
c. an elastic sheet member disposed in said mating groove so as to be sandwiched between said face plate and said golf club head whereby a golf club head having resistance to shock and good tonal qualities is produced.

8. The golf club head in accordance with claim 7 wherein said striking face is formed of material selected from the group consisting of: glass fibers, polyamide resin, acrylbutatiene styrol, ivory, wood, iron, plastic and combinations thereof.

9. The golf club head in accordance with claim 7 wherein said plastic film is a rubber film.

10. The golf club head in accordance with claim 7 wherein said face plate is made of a composition comprising about a. 90 wt. percent $Al_2O_3$;
b. 5 wt. percent $SiO_2$;
c. 3 wt. percent CaO; and
d. 2 wt. percent $K_2O + Na_2O$.

* * * * *